United States Patent [19]

Hedrick

[11] Patent Number: 4,667,204

[45] Date of Patent: May 19, 1987

[54] COMBINATION DUAL RHOMBIC AND V-TYPE ANTENNA FOR VHF-UHF TELEVISION RECEIVERS

[76] Inventor: James D. Hedrick, P.O. Box 225, Riverton, Va. 22651

[21] Appl. No.: 720,632

[22] Filed: Apr. 8, 1985

[51] Int. Cl.[4] ..... H01Q 11/06

[52] U.S. Cl. ..... 343/725; 343/735

[58] Field of Search ..... 343/731, 733–740, 343/725, 726, 729, 869, 878, 879, 893, 808, 809

[56] References Cited

U.S. PATENT DOCUMENTS

| | | | |
|---|---|---|---|
| 1,546,878 | 7/1925 | Alexanderson | 343/860 |
| 2,126,295 | 8/1938 | Warren | 343/733 |
| 2,145,024 | 1/1939 | Bruce | 343/736 |
| 2,194,554 | 3/1940 | Katzin | 343/733 |
| 2,207,504 | 7/1940 | Bohm | 343/733 |
| 2,244,628 | 6/1941 | Kotowski | 343/733 |
| 2,247,739 | 7/1941 | Werndl | 343/733 |
| 2,247,743 | 7/1941 | Beverage | 343/733 |
| 2,247,744 | 7/1941 | Bohm | 343/733 |
| 2,267,945 | 12/1941 | Peters | 343/733 |
| 2,379,706 | 7/1945 | Hansell | 343/733 |
| 2,485,773 | 10/1949 | Posthumus | 343/733 |
| 2,700,733 | 1/1955 | Brueckmann | 343/733 |
| 2,875,438 | 2/1959 | Hings | 343/733 |
| 3,453,622 | 7/1959 | McKesson | 343/733 |
| 3,475,759 | 10/1969 | Winegard | 343/701 |
| 3,573,832 | 4/1971 | Callaghan | 343/866 |
| 3,757,341 | 9/1973 | Gilbo | 343/733 |
| 3,928,854 | 12/1975 | Tacussel | 343/735 |

OTHER PUBLICATIONS

Viezbicke, "Interactions Between Nested Receiving Rhombic Antennas", IEEE Trans. on Antennas and Prop., vol. AP-12, No. 1, Jan. 1969.

*Primary Examiner*—Eli Lieberman
*Assistant Examiner*—Michael C. Wimer
*Attorney, Agent, or Firm*—Wilkinson, Mawhinney & Theibault

[57] ABSTRACT

A combination of two juxtaposed rhombic antennas and a V-antenna on a single, longitudinal, non-conductive support boom. The two rhombic antennas lie flat upon one another in substantially the same plane and are supported on the boom with insulating transverse spreader rods.

4 Claims, 2 Drawing Figures

COMBINATION DUAL RHOMBIC AND V-TYPE ANTENNA FOR VHF-UHF TELEVISION RECEIVERS

TECHNICAL FIELD

The present invention is directed to the adaptation of two rhombic antennas and a V-type antenna for use in the television receiver market which does not require the long wire systems of the prior art.

BACKGROUND OF THE INVENTION

The use of one or more rhombic antennas has been known since the 1940's as represented and illustrated in the following U.S. patents:

| | |
|---|---|
| 2,126,295 | 2,247,739 |
| 2,194,554 | 2,247,744 |
| 2,244,628 | 2,485,773 |
| 2,207,504 | 2,700,733 |

however they have not been combined with a V-type antenna and supported on a single longitudinal boom wherein the V-type antenna particularly advantageous in receiving VHF frequencies of single digit television channels can be selectively switched into and out of the circuit containing the two rhombic antennas and wherein the two rhombic antennas are mounted in contacting juxtaposed position on a single longitudinal boom.

SUMMARY OF THE INVENTION

The present invention combines two juxtaposed rhombic antennas on a single longitudinal support boom in which the two rhombics lie flat upon one another in substantially the same plane providing a low wind resistance and a good front to back ratio having substantially a zero angle of radiation. The combining of a V-type antenna with the two rhombics provides an improved signal in the channel 2 to 6 range permitting receiving signals coming from a greater distance to provide a much clearer picture on the television receiver overcoming the drawbacks of the conventional di-pole and reflector type antennas.

A further object of the present invention is to provide receiving antenna of the modified long-wire class which has a gain of 26 db UHF and 12–15 db VHF and having a front to back ratio of 30–40 db.

Another object of the invention is to provide an antenna as described above having a non-conductive boom and spreaders in which the rhombic wire runs (2) total approximately 90 feet of 10 to 14 gauge wire which may be either bare or covered. If bare the wires must be insulated from one another at their crossover points by either insulating sleeves or insultaing tape.

BEST MODE FOR CARRYING OUT THE INVENTION

Figure 1:
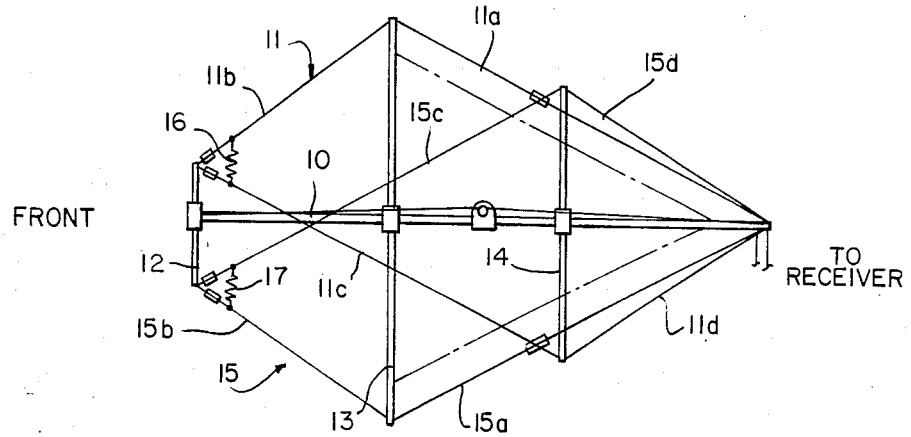
FIG. 1 is a top plan schematic of antenna of the present invention showing two rhombic antennas combined with a V-type antenna.

Referring now to the drawings, 10 designates a longitudinal support boom of a strong insulating material having spreader support rods 12, 13 and 14 which are also of insulating material spaced along the boom 10. These support rods may be anchored in insulating blocks 10*a*, 10*b* and 10*c* which are secured to the boom 10 by epoxy resin or other permanent bonding resin as the rods are secured to the blocks to form a rigid support structure upon which the antennas are mounted.

The first rhombic antenna 11 having lines 11*a*, 11*b*, 11*c* and 11*d* is mounted on boom 10 and maintains its rhombidal configuration by spreaders 12, 13 and 14. The antenna wire may be passed through openings in the rods or through insulated eyelets carried on the rod ends. A terminal block may be mounted at the rear of the boom 10 to receive the two ends of the first rhombic antenna 11 for connection to a TV receiver lead in cable through a suitable junction block.

The second rhombic antenna 15 has lines 15*a*, 15*b*, 15*c* and 15*d* which is mounted juxtaposed to antenna 11 in contacting superposed relationship living substantially in the same plane as antenna 11 and is secured to the insulating support rods 12, 13, 14 as in antenna 11. The crossover points of both antennas 11 and 15 at 23, 24 and 25 are insulated from one another by insulating sleeves or tape particularly when the antenna wire is bare or not covered. The second antenna 15 shares the same spreaders 12, 13, 14 and the same terminal block 26 as does antenna 11 for attachment to the receiver lead-in cable.

Each of the rhombic antennas 11 and 15 are connected at their apex to the support spreader 12 and have resistors 16, 17 which may have fixed values such as 600 ohms or they may be tuneable over a variable range and may further be selectively placed into and out of the rhombic circuit as desired dependent upon characteristics of the received incoming signal. The resistors may be tuned by standard relays or motor tuning circuits known to the art.

The longitudinal boom 10 is mounted on a mast 20 by clamp 20*a* and support wire 21 is connected to the mast 20 and to the boom 10 to each side of the mast to distribute the mechanical load and to act as a stabilizer against wind variables.

Each rhombic antenna 11 and 15 may be of 10 to 14 gauge bare or covered wire and if bare wire is employed the wires at crossover points 23, 24 and 25 must be insulated from one another.

Figure 2:
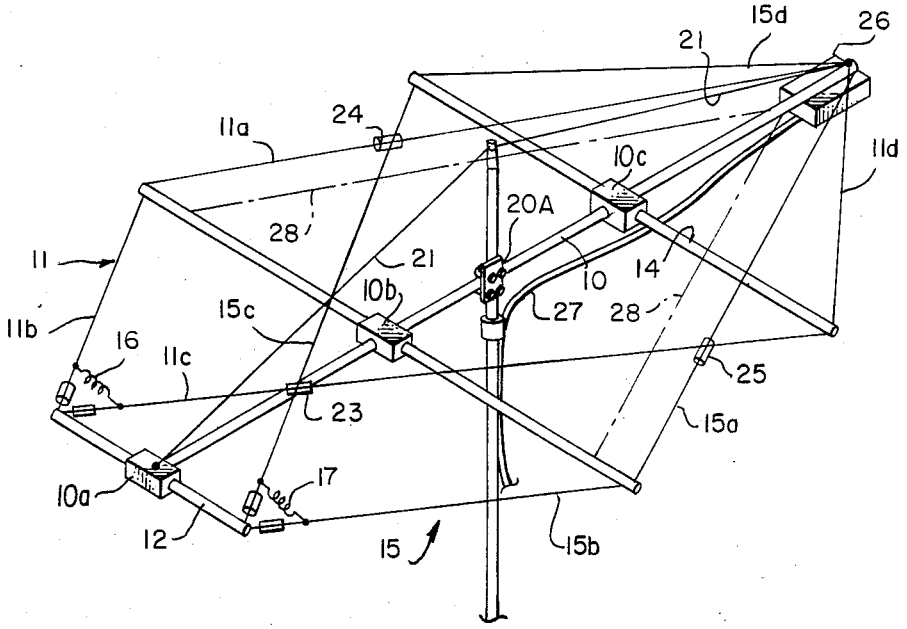
FIG. 2 is a perspective view of the double rhombic antennas mounted juxtaposed on a longitudinal support boom in combination with a V-type antenna mounted on a mast.

As shown in FIG. 2 the terminal leads of each rhombic antenna are connected to a terminal block 26 at the rear of the boom 10 for either series or parallel connection to a receiver lead-in line 27 from the antennas to a TV receiver.

A V-type antenna 28 is provided for enhancing the receiving of VHF signals and is constructed of a 4 to 5 strand individual insulated conductor cable each conductor of which is cut for receiving a specific range of television channel signal frequencies. This V-antenna 28 may be employed by itself as the sole antenna or it may be combined to receive also the signals from the two rhombic antennas through the terminal block 26 by selective switching structure known in this art.

The rhombic apex resistors 16, 17 may be cut in or out and may be single or additive and the rhombic antennas 11 and 15 may be placed in series or parallel by known switching.

The boom 10 is twenty feet long and the length of the wire runs of the rhombic antennas 11, 15 is approximately ninety feet. The boom 10 is mounted twenty feet above the ground for optimum reception.

What is claimed is:

1. For use with a receiver having a signal transmission line for connecting an antenna to a TV receiver; a TV receiving antenna for UHF and VHF signals comprising (a) a main longitudinal support boom of rigid insulating material having a leading and trailing end, (b) a first transverse spreader rod of insulating material mounted rigidly on said main longitudinal support boom at its leading end and extending off an insulating support block at a right angle to said longitudinal support boom, (c) a second transverse spreader rod of insulating material mounted rigidly on said main longitudinal support boom rearwardly of said first spreader rod and extending off an insulating support block normal to said main support boom, (d) a third transverse spreader rod of insulating material mounted rigidly on said main longitudinal support boom rearwardly of said second rod and extending transversely of said main longitudinal support boom at a right angle thereto, (e) a terminal block secured to said main longitudinal support boom at its trailing end, (f) a first rhombic antenna having a first leg connected between one end of said first spreader rod to one side of said main support boom and the free end of said second spreader rod to the same side of said main boom, a second leg of said first rhombic antenna connected between the free end of said second spreader rod and the trailing end of said main boom, a third leg of said first rhombic antenna being connected between said trailing end of said main boom and the free end of said third spreader on the opposite side of said main boom as said first and said second legs, and a fourth leg of said first rhombic antenna being connected to said first spreader rod at the point of attachment of said first leg of said first rhombic antenna to said first spreader rod, (g) a second rhombic antenna having a first leg connected between the end of said first spreader rod to the opposite side of said main boom from said first rhombic antenna first leg and the third spreader rod to the same side of said main boom as the second spreader rod supporting the first and second legs of said first rhombic antenna, a second leg of said second antenna being connected between said third spreader rod and said trailing end of said main support boom, a third leg of said second rhombic antenna being connected between the trailing end of said main boom and the free end of said second spreader rod opposite the connection of said first and second legs of said first antenna, and a fourth leg of said second rhombic antenna being connected to said first spreader rod at its end remote from the connections of the first and fourth legs of said first rhombic antenna, (h) resistors across the leading apex of each rhombic antenna in circuit with each antenna, (i) and, connector means on the trailing apex of each rhombic antenna and said terminal block for connection of said first and second rhombic antennas to a UHF/VHF receiver.

2. An antenna as claimed in claim 1 wherein the second spreader rod in longer than the first and third spreader rods.

3. An antenna as claimed in claim 2 further comprising a V antenna substantially co-planar with said first and said second rhombic antennas and supported by said longitudinal support boom and said second spreader arm.

4. An antenna as claimed in claim 1 wherein said rhombic antennas are of 90 feet of 10 to 14 gauge wire.

* * * * *